US006811498B2

(12) United States Patent
Emerson et al.

(10) Patent No.: US 6,811,498 B2
(45) Date of Patent: Nov. 2, 2004

(54) HIGH PERFORMANCE TWO PIECE GOLF BALL

(75) Inventors: Brent D. Emerson, Central, SC (US); George R. Wallace, Clemson, SC (US); Matthew B. Stanczak, Jackson, TN (US); Sanjay Kuttappa, Clemson, SC (US)

(73) Assignee: Dunlop Maxfli Sports, Westminster, SC (US)

( * ) Notice: Subject to any disclaimer, the term of this patent is extended or adjusted under 35 U.S.C. 154(b) by 64 days.

(21) Appl. No.: 09/884,651

(22) Filed: Jun. 19, 2001

(65) Prior Publication Data

US 2002/0016229 A1 Feb. 7, 2002

Related U.S. Application Data

(60) Provisional application No. 60/212,243, filed on Jun. 19, 2000.

(51) Int. Cl.[7] ..... A63B 37/04
(52) U.S. Cl. ..... 473/377; 473/378; 473/379
(58) Field of Search ..... 473/351–385

(56) References Cited

U.S. PATENT DOCUMENTS 4,142,727 A * 3/1979 Shaw et al. ..... 473/381
4,801,649 A * 1/1989 Statz ..... 525/183
4,884,814 A * 12/1989 Sullivan ..... 473/372
4,925,193 A 5/1990 Melvin et al.
5,009,427 A * 4/1991 Stiefel et al. ..... 473/379
5,192,078 A 3/1993 Woo
5,368,304 A * 11/1994 Sullivan et al. ..... 473/377
5,415,937 A * 5/1995 Cadorniga et al. ..... 428/407
5,575,477 A * 11/1996 Hwang ..... 473/379
5,580,057 A * 12/1996 Sullivan et al. ..... 273/DIG. 22
5,586,951 A * 12/1996 Sugiura ..... 473/379
5,683,312 A * 11/1997 Boehm et al. ..... 473/354
5,700,209 A * 12/1997 Sugiura ..... 473/380
5,733,207 A * 3/1998 Sullivan et al. ..... 273/DIG. 22
5,759,676 A * 6/1998 Cavallaro et al. ..... 428/215
5,779,561 A * 7/1998 Sullivan et al. ..... 273/DIG. 22
5,803,831 A 9/1998 Sullivan et al.
5,820,489 A * 10/1998 Sullivan et al. ..... 273/DIG. 20
5,965,669 A * 10/1999 Cavallaro et al. ..... 473/372
6,126,559 A * 10/2000 Sullivan et al. ..... 473/378
6,193,616 B1 * 2/2001 Sullivan et al. ..... 473/351
6,218,453 B1 * 4/2001 Boehm et al. ..... 524/433
6,241,627 B1 * 6/2001 Kasashima et al. ..... 473/378
6,302,808 B1 * 10/2001 Dalton et al. ..... 473/371
6,315,684 B1 * 11/2001 Binette et al. ..... 473/377
6,325,731 B1 * 12/2001 Kennedy et al. ..... 473/377
6,346,054 B1 * 2/2002 Shimosaka et al. ..... 473/378
6,383,093 B1 * 5/2002 Kuttappa et al. ..... 473/378
6,433,094 B1 * 8/2002 Nesbitt et al. ..... 525/221

* cited by examiner

*Primary Examiner*—Gregory Vidovich
*Assistant Examiner*—Alvin A. Hunter, Jr.
(74) *Attorney, Agent, or Firm*—Lorusso Loud & Kelly LLP; Jeffrey D. Washville; Marc A. Vivenzio

(57) ABSTRACT

A two piece golf ball has a core compression in the range of 75 PGA to 89 PGA, a core diameter in the range of about 1.535 inches to 1.545 inches, a cover hardness in the range of 42 to 60 Shore D, and a dimple pattern based on the geometry of a icosahedron. An uninterrupted equatorial great circle path, corresponding to a mold parting line, is provided in the design for forming a cover of the golf ball in two parts. A ball having such characteristics exhibits superior distance performance without compromising shot-making feel.

24 Claims, 5 Drawing Sheets

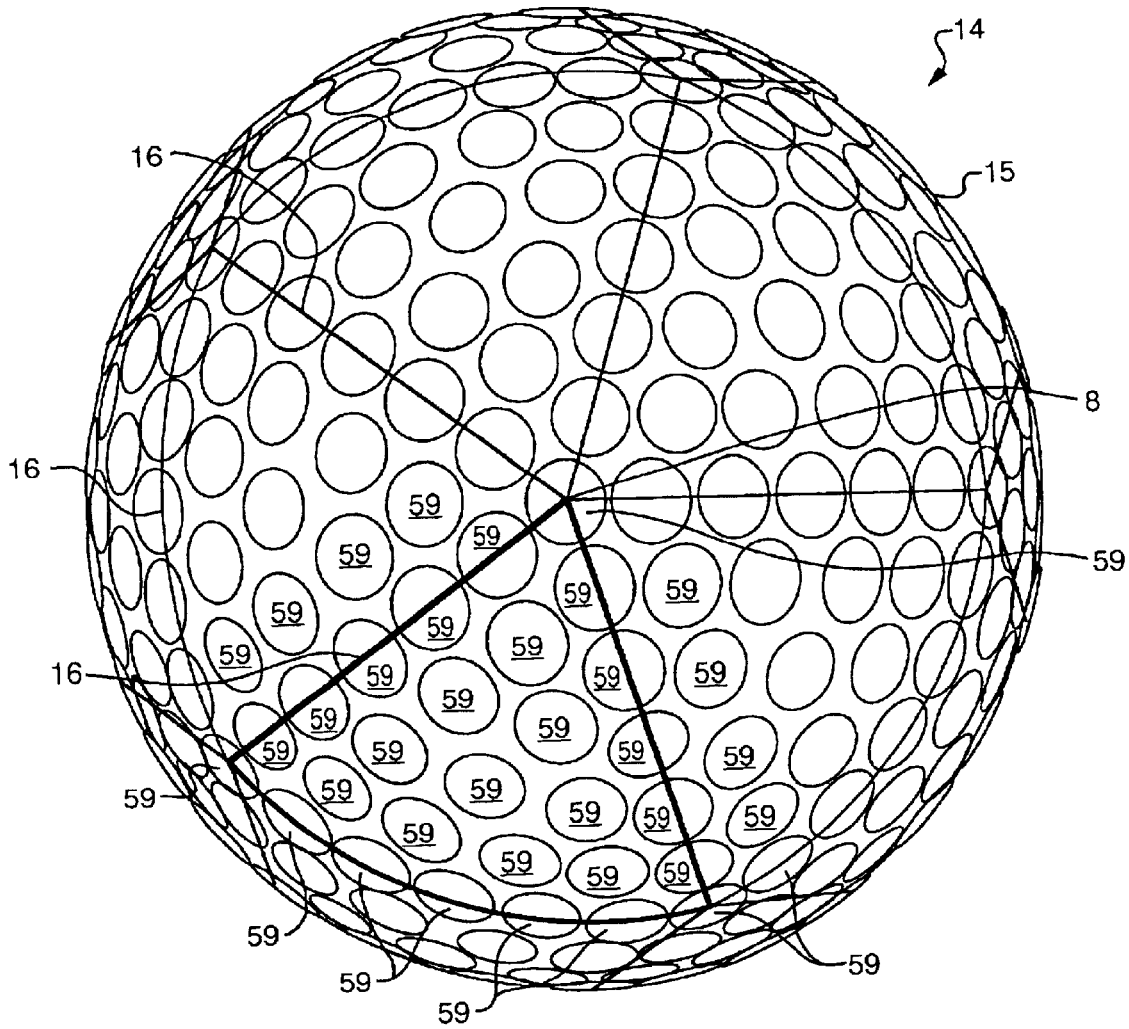
14
15
16
16
16
8
59
59
59

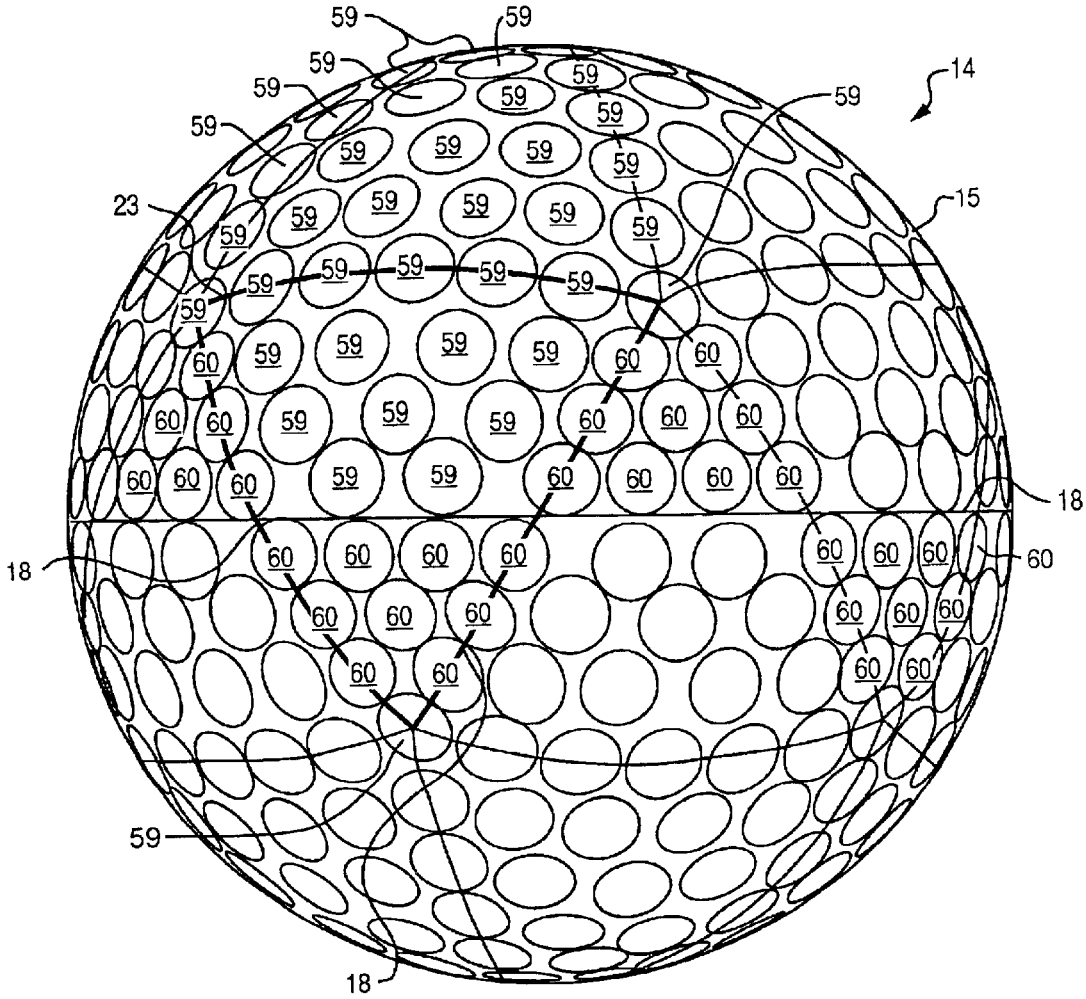
59
59
59

HIGH PERFORMANCE TWO PIECE GOLF BALL

CROSS-REFERENCE TO RELATED APPLICATIONS

This is a continuation-in-part application of the provisional application No. 60/212,243 filed Jun. 19, 2000, the contents of which are incorporated herein by reference.

BACKGROUND OF THE INVENTION

The instant invention is directed to golf balls, and more particularly to a ball having the optimal core compression, core diameter, cover hardness, and dimple configuration to provide superior playability characteristics with respect to softness and spin without sacrificing superior distance capabilities.

DESCRIPTION OF THE PRIOR ART

There are a number of physical properties that affect the performance of a golf ball. The core of the golf ball is the source of the ball's energy. Among other things, the core affects the ball's "feel" and its initial velocity. The "feel" is the overall sensation transmitted to the golfer through the golf ball after striking a ball. The initial velocity is the velocity at which the golf ball travels when first struck by the golf club. The initial conditions, which includes velocity, together with the ball's trajectory, determine how far a shot will travel.

Until the late 1960's most golf balls were constructed as three-piece wound balls. In the three-piece wound ball, a solid or liquid-filled center is wound with rubber windings to form a core, which is then surrounded with a cover of compounds based on natural (balata or gutta percha) or synthetic transpolyisoprene. During the manufacturing process, after the liquid-filled center is formed, it is frozen to make it as hard as possible so that it will retain its spherical shape while the rubber thread is wrapped around it.

These three-piece wound balls were known and are still known to provide acceptable flight distance and soft feel. Additionally, due to the relative softness of the balata cover, skilled golfers are more able to impart various spins on the ball in order to control the ball's flight path (e.g. "fade" or "draw") and check characteristics upon landing on a green.

With the advent of new materials developed through advances and experimentation in polymer chemistry, two-piece golf balls were developed. The primary difference between a two-piece golf ball and a three-piece golf ball is the elimination of the rubber thread windings found in the three-piece balls. A relatively large solid core in a two-piece ball takes the place of the relatively small center and thread windings of a three-piece ball core having the same overall diameter. With the elimination of the thread windings, there is no need to freeze the core during the manufacturing process of the two-piece golf ball.

Two-piece balls have proven to be more durable than three-piece balls when repeatedly struck with golf clubs and more durable when exposed to a variety of environmental conditions. An example of these environmental conditions is the high temperature commonly experienced in an automobile trunk. In addition, two piece balls are typically less expensive to manufacture than the three-piece wound balls. However, two-piece balls are, in general, considered to have inferior characteristics of feel and workability when compared to three-piece balls. Generally and historically, two piece balls use harder cover materials for increased durability. The "hardness" of a golf ball can affect the "feel" of a ball and the sound or "click" produced at contact. "Feel" is determined as the deformation (i.e. compression) of the ball under various load conditions applied across the ball's diameter. Generally, the lower the compression value, the softer the "feel." Consequently, two-piece golf balls have a higher initial velocity. In addition, typically two-piece golf balls have more potential energy, which is derived primarily from the core. The cores in two piece golf balls are typically larger than the centers in three-piece golf balls.

In contrast, three-piece golf balls with their smaller centers historically use softer cover materials. These softer cover materials result in a lower initial velocity when compared to two-piece golf balls. However, this difference in the initial velocity may be somewhat made up by the windings in the three-piece golf ball.

In addition to manipulating the core and cover of a golf ball, for many years golf balls have been made with surface indentations or depressions, called dimples, to improve their aerodynamic properties in flight. Specifically, ball manufacturers have looked to dimple configurations in an effort to design a ball with superior distance capabilities. Many efforts have been made to select the optimum number, size and shape of dimples as well as their disposition around the outer surface of a generally spherically shaped golf ball.

Ball manufacturers are bound by regulations of the United States Golf Association (USGA) which control many characteristics of the ball, including the size and weight of the ball, the initial velocity of the ball when tested under specified conditions, the overall distance the ball travels when hit under specified test conditions, and the ball's aerodynamic symmetry. Under USGA regulations, the diameter of the ball cannot be less than 1.680 inches, the weight of the ball cannot be greater than 1.620 ounces avoirdupois, the initial velocity of the ball cannot be greater than 250 feet per second when tested under specified conditions (with a maximum tolerance of +2%), the driver distance cannot exceed 280 yards when tested under specified conditions (with a test tolerance of +6%), and the ball must perform the same aerodynamically regardless of orientation.

While the USGA sets a limit for the distance a ball can travel under set test conditions, there is no upper limit on how far a player can hit a ball. For example, U.S. Pat. No. 5,575,477 discloses the projection of an icosahedron onto the ball as a basis for a dimple configuration. The balls twenty triangles are then further divided by six great circle paths which are devoid of dimples. U.S. Pat. No. 5,249,804 discloses a golf ball having a dimple pattern based on an icosahedron pattern consisting of twenty triangles. The preferred embodiment contains 362 dimples of two different diameters.

A problem with the prior art dimple configurations is that they fail to take into account other features of the ball, such as core size, core compression and cover hardness, which also influence how far a ball will travel.

U.S. Pat. No. 5,368,304 to Sullivan discloses a ball having a low spin rate, which in turn enables the ball to travel greater distances. According to the Sullivan patent, the low spin rate is the result of a soft core and hard cover. While the '304 patent discloses the use of a soft core and hard cover to lower the spin rate, it does not disclose a dimple configuration for the ball.

OBJECT OF THE INVENTION

Accordingly, it is an object of the instant invention to provide a two-piece golf ball that has a soft feel in combination with superior distance capabilities.

It is another object of the instant invention to optimize the combination of core compression, core size, core composition, dimple configuration, cover composition, and cover hardness to provide a two-piece golf ball, which travels great distances, and at the same time complies with USGA regulations.

It is yet another object of the instant invention to provide a two-piece golf ball having a synthetic cover material that achieves the sound, feel, playability and flight performance qualities of balata covered golf balls.

It is a further object of the instant invention to lower the cost of manufacturing a two-piece golf ball that has a soft feel in combination with superior distance capabilities.

It is still a further object of the instant invention is to provide a two-piece golf ball having superior distance, trajectory and flight stability.

Another object of the instant invention is to provide a two-piece golf ball having a surface divided into a plurality of polygonal configurations or shapes for the location of dimples for enhancing the aerodynamic properties of the golf ball.

SUMMARY OF THE INVENTION

The invention achieves the above-described objectives by providing a two-piece golf ball having a solid rubber core, a synthetic ionomer resin cover, and a "icosahedron" dimple pattern. The ball of the instant invention has a core compression in the range of 68 PGA to 78 PGA; a core diameter in the range of about 1.535 inches to about 1.545 inches; a cover hardness in the range of about 53 Shore D to about 59 Shore D, and a dimple pattern based on the geometry of an icosahedron. This combination has been found to produce a ball with superior distance capabilities, which also satisfies USGA regulations. The use of these properties in the golf ball of the instant invention is based on the recognition that it is the combination of the core compression, core composition, core size, cover composition, cover hardness, dimple configuration, dimple size and dimple shape that will produce a ball that will travel the greatest distance without compromising shot-making feel.

The cover material can be constructed from any relatively stiff material, for example, synthetic thermoplastic materials. Most notably these synthetic thermoplastic materials are ionomeric resins. Ionomeric resins are polymers containing interchain ionic bonding. As is well known in the chemical arts, ionomeric resins are generally ionic copolymers of an olefin having from about two to about eight carbon atoms, such as ethylene and a metal salt of an unsaturated carboxylic acid, such as acrylic acid, methacrylic acid, or maleic acid. The pendent ionic groups in the ionomeric resins interact to form ion-rich aggregates contained in a non-polar polymer matrix. Metal ions, such as sodium, lithium, zinc or magnesium are used to neutralize some portion of the acidic groups in the copolymer. This results in a thermoplastic elastomer, which exhibits enhanced flight characteristics and durability when compared to golf balls constructed with balata covers. However, the advantages gained by enhanced durability have been offset by the decreased playability properties.

The ionomers used in the cover composition are sold by E.I. Dupont De Nemours & Company under the name SURLYN. In an attempt to overcome the negative factors of the hard ionomer covers, DuPont introduced low modulus SURLYN ionomers in the early 1980's. These SURLYN ionomers have a flexural modulus of from about 3000 to about 7000 PSI and hardness of from 25 to about 50 as measured on the Shore D scale—ASTM 2240. The low modulus ionomers are terpolymers, typically of ethylene, methacrylic acid and n- or iso-butylacrylate, neutralized with sodium, zinc, magnesium or lithium cations. E.I. DuPont De Nemours & Company has disclosed that the low modulus ionomers can be blended with other grades of previously commercialized ionomers of high flexural modulus from about 30,000 to 75,000 PSI to produce balata-like properties. However, soft blends, typically 52 Shore D and lower (balata-like hardness), are still prone to cut and shear damage.

The low modulus ionomers when used without high flexural modulus blends produce covers with very similar physical properties to those of balata, including poor cut and shear resistance. Worse, wound balls with these covers tend to go "out-of-round" quicker than wound balls with balata covers. Blending with hard SURLYN ionomers was found to improve these properties.

It has now been discovered that a blend of very low modulus ionomers with an associated low acid level with an improved flow ionomer containing a medium acid level results in a golf ball cover with improved playability characteristics. For the purposes of the SURLYN ionomer resin grade designations, a low acid level is approximately 12% by weight, and a medium acid level is approximately 15% by weight.

As mentioned previously, in addition to manipulating the core and cover parameters in a golf ball, superior aerodynamic properties are also attributed to the dimple configuration on a golf ball. In the instant invention, the dimples are arranged on the surface of the golf ball based on the geometry of a icosahedron. This configuration is achieved by dividing the outer spherical surface of a golf ball by into a plurality of triangles for locating a plurality of dimples on the outer surface of the golf ball. This polygonal configurations is generally referred to herein as a "icosahedron".

The outer surface has a plurality of dimples of different sizes. In one embodiment, the dimples are of first, and second sizes and are generally located to have a pattern associated with the triangles. Dimples are preferably circular in shape, but can have a non-circular shape within the scope of this invention.

The combination of the aforementioned core, cover and dimple specifications produces a golf ball that possesses noticeable improvements in playability (i.e. spin properties) without sacrificing the ball's durability (i.e. impact resistance etc.) which in turn relates directly to the distance a ball will travel when struck. In addition, the instant invention provides a golf ball composition that exhibits the desired properties of the three-piece wound ball (e.g. long distance in combination with a soft feel), but with the lower manufacture cost associated with the two-piece ball. These and other objects of the instant invention will be apparent from a reading of the following detailed description of the instant invention.

BRIEF DESCRIPTION OF THE DRAWING

FIG. 3 is an elevation view of the golf ball of this invention showing the relative locations of triangles formed on the outer surface with a pole at the center.

FIG. 4 is an equatorial view of the ball of preferred embodiment of the instant invention.

DETAILED DESCRIPTION OF THE PREFERRED EMBODIMENT

Figure 1:
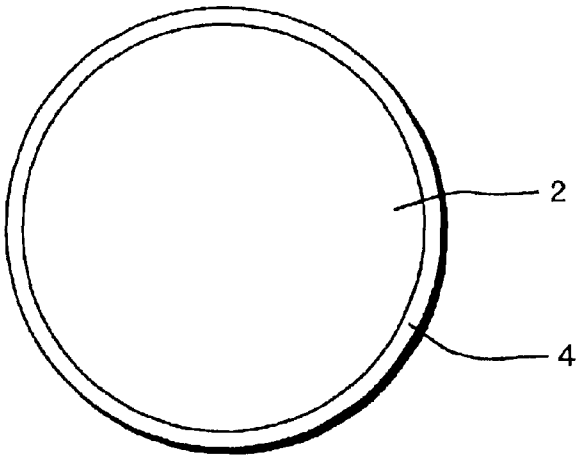
FIG. 1 is a sectional view of a golf ball made in accordance with one embodiment of the invention.

FIG. 1 shows a section view of a two-piece golf ball made in accordance with the preferred embodiment of the instant invention. A two-piece golf ball has a solid rubber core 2 and a cover 4. The solid rubber core 2 is manufactured by using conventional compression molding processes. The components are mixed together and extruded to form preforms, which are then placed in cavities in the mold and are compression molded under pressure and cured/vulcanized to form cores. The same mix may also be injection molded. Curing is carried out in the mold at temperatures of 280–380 degrees F for five to twenty minutes depending on the compound. Once fully cured, the cores are removed from the mold cavities and prepared for application of a cover.

In the preferred embodiment, the golf ball core 2 is made of a solid rubber composition comprising a polybutadiene rubber center of a composition typical to the industry. Specifically, the rubber may be 90–100 PHR polybutadiene, 0–10 PHR polyisoprene, 20–35 PHR zinc diacrylate, 3–10 PHR zinc oxide, 0–30 PHR fillers, process aids and antioxidants, and 0.5–5 PHR peroxide initiator. In the preferred embodiment, the diameter of the solid rubber core 2 is about 1.540±0.005". The core 2 weighs about 36.75±0.50 grams, and has a PGA compression of about 82±7.

As is well known in the art, the type and amount of crosslinking agents used to make the core will have the greatest influence on the core compression achieved. To prepare the core 2 according to the preferred embodiment, it has been found that a core composed primarily of high-cis polybutadiene in combination with cross-linking agents, activators, initiators and fillers (active and inactive), can be used to achieve a golf ball core having the desired compression characteristics. As used herein, high-cis means a cis isomer content of greater than 93%. It is to be understood that the core formula set forth herein is but one formula that can be used to make a core having the desired core compression.

Once formed, the solid rubber core 2 is then subjected to a conventional molding process whereby the polymer cover 4 is injection molded around the core 2 in a manner well known to those skilled in the art. To make the cover, the blended components of the cover are injection molded into cavities, which contain cores suspended in the center of the cavities. The inner surfaces of the cavities are constructed with dimple-shaped projections, which form the dimples in the cover. The process used to make the cover is the standard process used and well known in the art wherein one or more components are added together to form a blend which is then injected into the mold. After molding, the golf balls produced may undergo further processing steps such as pressure blasting, vibratory finishing, stamping of the logo, application of a primer, and finally, application of a top coat.

In the preferred embodiment, the cover has a thickness of about 0.070" when combined with the core for a total diameter of 1.680", the commercial ball diameter standard specified by the United States Golf Association.

As discussed previously, the cover material is comprised of ionomer resins available from E.I. du Pont de Nemours & Co. under the name SURLYN. In the preferred embodiment, the ionomers are about 66% by weight of SURLYN 6320 and about 34% by weight of SURLYN 8945. The hardness of the cover is about 56±3 Shore D.

Under the Dupont SURLYN resin classification system, the 6320 SURLYN ionomer is a soft ionomer. This very low modulus ionomer uses the Magnesium metal ion to neutralize the acid groups, and its acid level is about 12% by weight. Moreover, the 6320 SURLYN grade is copolymerized n-butyl acrylate. Finally, the 6320 SURLYN resin has a melt index of about 1.1. The polymer can be replaced with any terpolymer comprising an n-butyl acrylate, a similar olefin and an unsaturated carboxylic acid having a melt index from about 0.5 to 3.0 grams/10 minutes.

The 8945 SURLYN resin is classified as an improved-flow ionomer which has a medium acid level of about 15% by weight, which in turn produces a resin characterized by a medium stiffness level. The 8945 SURLYN resin uses the sodium ion to neutralize the acid groups, and it does not employ a terpolymer. Finally, the 8945 SURLYN resin has a melt index of about 4.0. The polymer can be replaced with a similarly performing olefin/unsaturated carboxylic acid copolymer having a melt index of about 2.0 to 6.0 grams/10 minutes.

In addition to the SURLYN resins, the cover composition contains color concentrate for coloring the golf ball in an amount well known to those skilled in the art.

Turning now to the dimple technology employed in the instant invention, as stated previously, the preferred geometry is a icosahedron. Accordingly, the scope of this invention provides a golf ball mold whose molding surface contains a uniform pattern to give the golf ball a dimple configuration superior to those of the art. The invention is preferably described in terms of the golf ball that results from the mold, but could be described within the scope of this invention in terms of the mold structure that produces a golf ball.

Figure 2A:
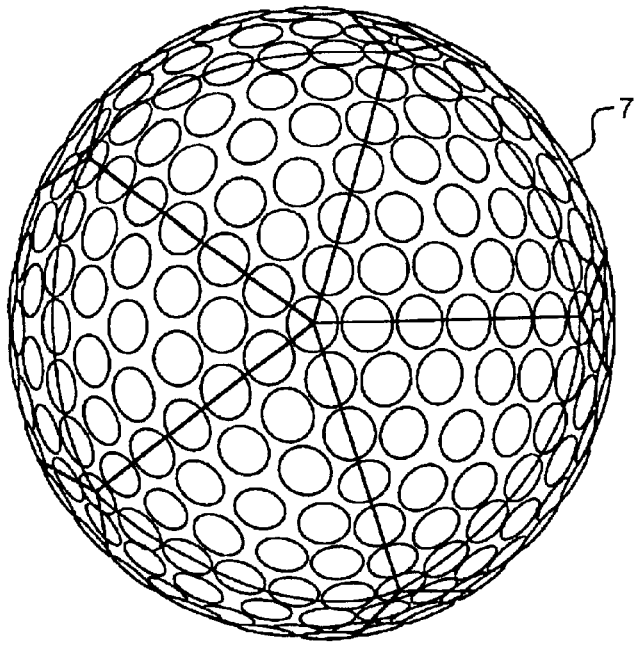
FIG. 2 is an elevation view of the outer surface of a golf ball being divided into a plurality of polygonal configurations according to the invention.
Figure 2B:
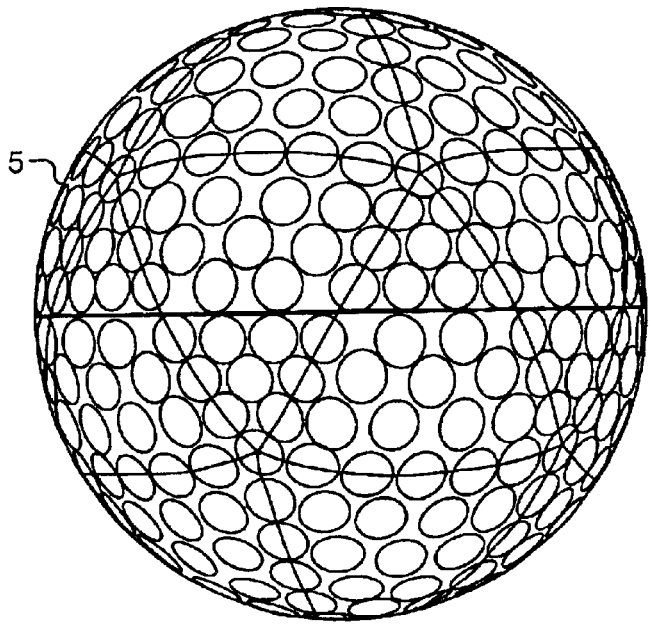

To assist in locating the dimples on the golf ball, the golf ball of this invention has its outer spherical surface partitioned by the projection of a plurality of polygonal configurations onto the outer surface. That is, the formation or division that results from a particular arrangement of polygons on the outer surface of a golf ball is referred to herein as a "plurality of polygonal configurations." A view of one side of a golf ball 5 showing a preferred division of the golf ball's outer surface 7 is illustrated in FIG. 2.

In the preferred embodiment, referring to FIG. 3 and 4, the present invention 14 has an outer surface 15 where a polygonal configuration known as a icosahedron is projected onto the surface of a sphere by a plurality of edges 16 and 17. A icosahedron is a type of polyhedron which contains twenty (20) triangles The term "icosahedron" means a twenty (20) sided polyhedron.

The icosahedron of the preferred embodiment is comprised of twenty (20) triangles forming a uniform pattern of triangles. The uniform pattern is based on five (5) polar triangles 22 verticies extends from each polar region 8 of the ball forming a total of ten polar triangles. Ten (10) equatorial triangles 23 are formed from the boundaries defined by the ten (10) polar triangles. The term equatorial refers to the parting line of the ball. The base boundary lines of each equatorial triangle are common with a polar triangle boundary line, the consequent vertices are common between both the equatorial and polar triangles. The equatorial triangles all share two boundaries with an adjacent equatorial triangle. All twenty (20) triangles are formed from the projection of a Platonic solid of an icosahedron onto the surface of the ball.

Figure 5:
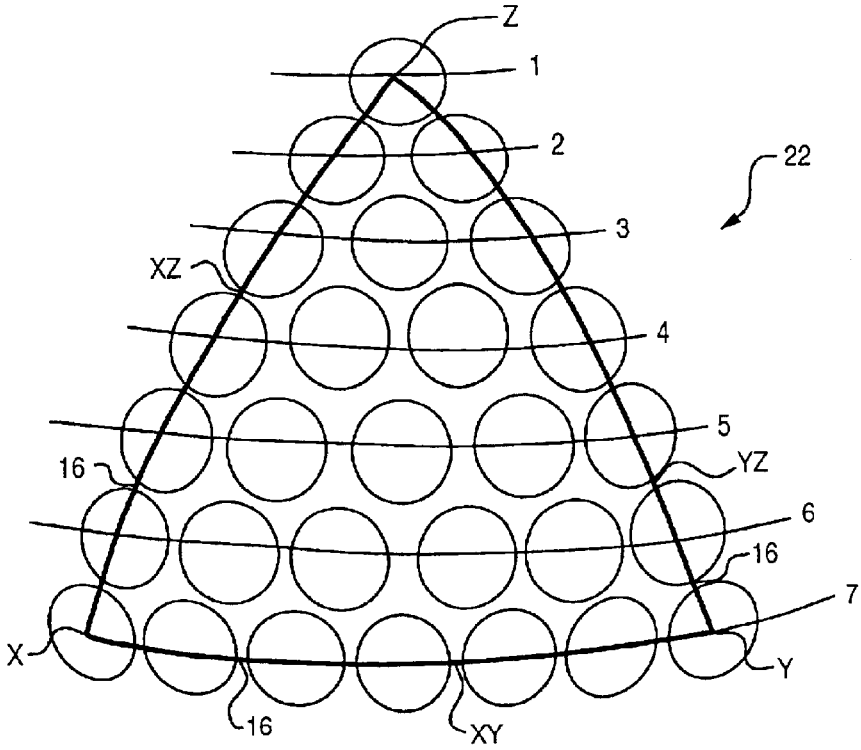
FIG. 5 is a view of the ball shown in FIG. 3, and includes the polar triangles projected thereon.
Figure 6:
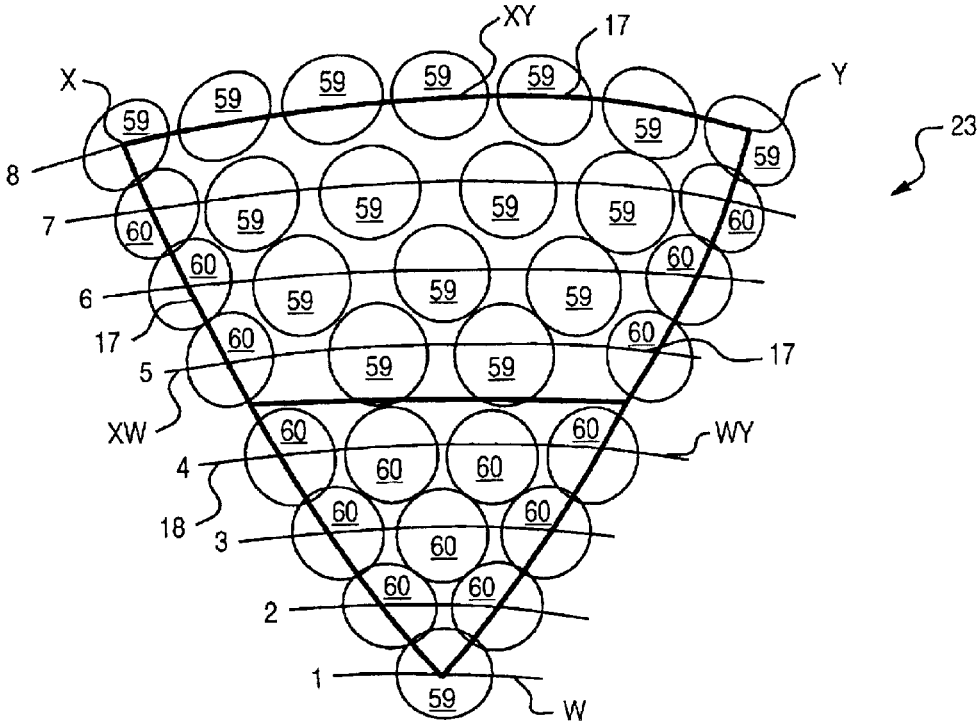
FIG. 6 is a view of the ball shown in FIG. 4 and include equatorial triangles projected thereon.

FIGS. 5 and 6 of the preferred embodiment refers to the triangles formed at the pole and the equator respectively. In FIG. 5, triangular section 22 is defined by the three edges 16 with vertex positions of X, Y, and Z and the corresponding equal sides of XY, YZ, and ZX. The vertex position Z always corresponds to pole 8 of the golf ball.

In FIG. 6, triangular section 23 is defined by the three edges 17 with vertex positions of X, W, Z and corresponding equal sides of XW, WY, YX. Triangle 23 is always associated with the mold parting line 18, and thus intersects it. The W vertex of triangle 23 will correspond to a vertex position of X or Y in triangle 22 when the triangles are projected onto the outer spherical surface.

For triangular section 22, dimples 59 are made on the outer surface 15 and arranged on the edges 16 that define the triangular section 22 of the polar region of the projected icosahedron. Twenty eight dimples 59 are placed in the triangular section 22 and are associated with seven rows. The seventh row, defined by XY, is associated with seven dimples 59, with the number of dimples in subsequent rows corresponding to row number designation.

For triangular section 23, dimples 59 and 60 are made on the outer surface 15 and arranged on the edges 17 that define the triangular section 23 of the equator region of the projected icosahedron. Seventeen dimples 59 and fifteen dimples 60 are placed in the triangular section 23 utilizing eight rows. The eighth row is associated with seven dimples 59. Rows seven through five can be described as having (R-3) dimples 59 between two dimples 60, where R is the row number designation. Rows four through two can be described as having R dimples 60. Row one contains one dimple 59.

Figure 7:
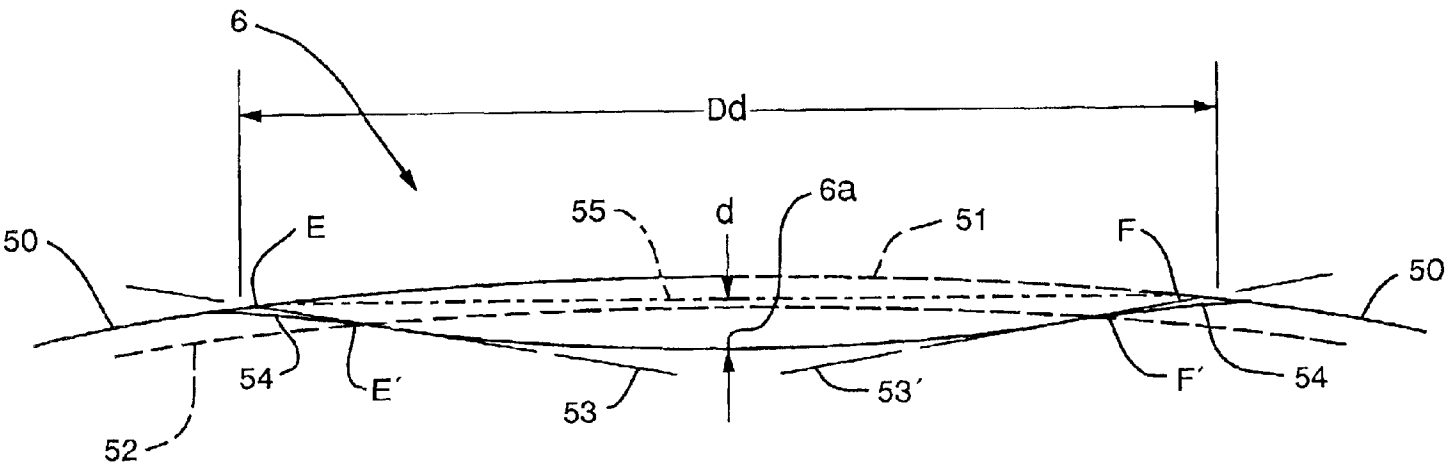
FIG. 7 is a cross sectional view cut through one of the dimples on the outer surface of the ball.

Dimple size is measured by a diameter and depth generally according to the teachings of U.S. Pat. No. 4,936,587 (the '587 patent), which is included herein by reference thereto. An exception to the teaching of the '587 patent is the measurement of the depth, which is discussed below. A cross-sectional view through a typical dimple 6 is illustrated in FIG. 7. The diameter Dd used herein is defined as the distance from edge E to edge F of the dimple. Edges are constructed in this cross-sectional view of the dimple by having a periphery 50 and a continuation thereof 51 of the dimple 6. The periphery and its continuation are substantially a smooth surface of a sphere. An arc 52 is inset about 0.003 inches below curve 50-51-50 and intersects the dimple at point E' and F'. Tangents 53 and 53' are tangent to the dimple 6 at points E' and F' respectively and intersect periphery continuation 51 at edges E and F respectively. The exception to the teaching of '587 noted above is that the depth d is defined herein to be the distance from the chord 55 between edges E an F of the dimple 6 to the deepest part of the dimple cross sectional surface 6(*a*), rather than a continuation of the periphery 51 of an outer surface 50 of the golf ball.

In the preferred embodiment, dimples 59 and 60 are single radius in nature. As seen in FIG. 7, dimples 59 have a diameter Dd of 0.143" and a corresponding depth d of 0.0078" (as measured from the chord 55 to bottom of the dimple 54). Dimples 60 have a diameter Dd of 0.132" and a corresponding depth d of 0.0076" (as measured from the chord 55 to bottom of the dimple 54).

The outer surface of the ball is further defined by a pair of poles and an uninterrupted equatorial great circle path around the surface. A great circle path is defined by the intersection between the spherical surface and a plane, which passes through the center of the sphere. Although an infinite number of great circle paths may be drawn on any sphere, there is only one uninterrupted great circle path, which corresponds to a mold parting line, and which gives the ball enhanced aerodynamic properties as well as enhanced symmetry. The uninterrupted great circle path is uninterrupted as a result of being free of dimples. The mold parting line is located from the poles in substantially the same manner as the equator of the earth is located from the north and south poles.

In the preferred embodiment, there are a total of 392 dimples. Advantageously, this decrease in the number of dimples when compared to prior art golf balls results in a geometrical configuration that contributes to the aerodynamic stability of the instant golf ball. Aerodynamic stability is reflected in greater control over the movement of the instant golf ball.

The dimple configuration of the preferred embodiment is shown in FIGS. 2–6. It is based on the projection of the icosahedron shown in FIGS. 3 and 4. The ball has a total of 392 dimples. The plurality of dimples on the surface of the ball are selected from two sets of dimples, with each set having different sized dimples. Dimples 59 are in the first set, and dimples 60 are in the second set. The mold parting line 30 is the only dimple free great circle path on this ball.

Advantageously, the use of a single uninterrupted mold parting line leads to superior aerodynamic properties in the instant golf ball. The single mold parting line results in less severe separation between the dimples, i.e. fewer "bald spots" on the surface of the ball. This in turn increases the effectiveness of the dimples on the golf ball. Advantageously, increasing the effectiveness of the dimples by reducing the land area on the surface of the golf ball improves the aerodynamic properties of the instant golf ball with regard to distance and control.

The following examples are provided to illustrate and further explain the beneficial effects of the ball described above. These examples are set forth for the purposes of illustrating the advantages obtained with the combination of the core compression, core size, cover composition, cover hardness, cover thickness, dimple configuration, and dimple number that will produce a ball that will travel the greatest distance without compromising shot-making feel.

It will be appreciated that the instant specification and claims are set forth by way of illustration and do not depart from the spirit and scope of the instant invention. It is to be understood that the instant invention is by no means limited to the particular embodiments herein disclosed, but also comprises any modifications or equivalents within the scope of the claims.

We claim:

1. A two-piece golf ball comprising:

a core having a compression in the range of about 75 PGA to about 89 PGA;

a cover having a Shore V hardness in the range of about 42 Shore D to about 60 Shore D;

an outer surface divided into a plurality of polygonal configurations, which include polar triangles, and, a plurality of dimples comprising sets of dimples having different diameters arranged on the outer surface, wherein the polar triangles only contain dimples from one set.

2. The ball of claim 1 wherein the core has a diameter in the range of about 1.535 inches to about 1.545 inches.

3. The ball of claim 1 wherein the core has a weight in the range of about 36.25 grams to about 37.25 grams.

4. The golf ball of claim 1 wherein the cover further comprises:

a blend of polymers wherein said blend comprises:

a terpolymer of ethylene/methacrylic acid/n-butyl acrylate; and, a copolymer of ethylene/methacrylic acid wherein said blend has a hardness of 53 to 59 Shore D.

5. The golf ball of claim 4 wherein said terpolymer has a melt index of about 0.5 to 3 g/10 minutes.

6. The golf ball of claim 4 wherein said copolymer has a melt index of about 2 to 6 g/10 minutes.

7. The golf ball of claim 4 wherein said terpolymer is 30% to 80% by weight of said blend and said copolymer is 20% to 40% of said blend.

8. The ball of claim 1 wherein the cover has a thickness of about 0.070 inches.

9. The golf ball of claim 1 wherein said outer surface is divided into a polyhedron defined as an icosahedron.

10. The golf ball of claim 9 further comprising twenty triangles for further dividing said outer surface, said triangles consist of a plurality of polar triangles and a plurality of equatorial triangles, wherein said polar triangles are divided into seven rows, and said equatorial triangles are divided into eight rows to obtain an outer surface consisting of subdivided triangles.

11. The golf ball of claim 9 wherein said of said polar triangles bisect dimples only from said first set of dimples and wherein said vertices of said polar triangles intersect said midpoint of dimples only from said first set of dimples.

12. The golf ball of claim 9 wherein said sides of said equatorial triangles bisect dimples only from said second set of dimples and wherein said vertices of said equatorial triangle are selected from said first set of dimples.

13. The golf ball of claim 10 wherein sides of each polar triangle are intersected by at least one dimple from the first set of dimples.

14. The golf ball of claim 13 wherein said uninterrupted equatorial great circle path is not intersected by any dimples.

15. The golf ball of claim 10 wherein the common sides of each equatorial triangle are intersected by a dimple from the second set of dimples.

16. The golf ball of claim 1 further comprising:

a first set of dimples, with each dimple in the first set having a first size;

a second set of dimples, with each dimple in the second set having a second size, wherein the plurality of dimples are selected from the first set of dimples, and the second set of dimples.

17. The golf ball of claim 1 further comprising:

two poles, an uninterrupted equatorial great circle path that is free of dimples and that defines a mold line symmetrically positioned with respect to said two poles on said outer surface; and a pair of first polygonal configurations each being located on opposite sides of said outer surface with respect to mold parting line to include one of said two poles symmetrically arranged within its boundaries.

18. The golf ball of claim 1 wherein said dimples are essentially circular with each one of said dimples having a size defined by a diameter in the range or about 0.13 inches to about 0.15 inches, and a depth in the range of about 0.0025 inches to about 0.125 inches.

19. The golf ball of claim 1 wherein the total number of dimples is at least 392.

20. A two-piece golf ball comprising:

a core having a compression in the range of about 68 PGA to about 78 PGA;

a cover having a Shore D hardness in the range of about 42 Shore D to about 60 Shore D; and an outer surface divided into a plurality of polygonal configurations, wherein the plurality of polygonal configurations includes polar triangles and equatorial triangles; and, at least 392 dimples arranged on the outer surface, with a first pattern of dimple associated with each triangle, a second pattern of dimples associated with each triangle, wherein said dimples are essentially circular with each one of said dimples having a size defined by a diameter in the range of about 0.13 inches to about 0.15 inches, and a depth in the range of about 0.0025 inches to about 0.125 inches a first pattern of dimples associated with each polar triangle having dimples from only one set, wherein the at least 392 dimples are selected from sets of dimples having different diameters arranged on the outer surface.

21. The golf ball of claim 20 wherein the cover further comprises:

a blend of polymers wherein said blend comprises:

a terpolymer of ethylene/methacrylic acid/n-butyl acrylate; and, a copolymer of ethylene/methacrylic acid wherein said blend has a hardness of 53 to 59 Shore D.

22. The golf ball of claim 21 wherein said terpolymer is 30% to 80% by weight of said blend and said copolymer is 20% to 40% of said blend.

23. The two-piece golf ball of claim 20 further comprising:

a second pattern of dimples associated with each equatorial triangle having dimples from all sets, wherein the at least 392 dimples are selected from sets of dimples with different diameters arranged on the outer surface.

24. A two-piece golf ball comprising a core having a compression in the range of about 75 PGA to about 82 PGA;

a cover having a Shore D hardness in the range of about 42 Shore D to about 60 Shore D;

an outer surface divided into a plurality of polygonal configurations, which include polar triangles; and, a plurality of dimples comprising sets of dimples having different diameters arranged on the outer surface, wherein the polar triangles only contain dimples from one set.

* * * * *